United States Patent [19]

Ybanez

[11] Patent Number: 4,728,002

[45] Date of Patent: Mar. 1, 1988

[54] BEVERAGE CAN

[76] Inventor: Israel G. Ybanez, HCR 7, Box 52, Los Ybanez, Tex. 79331

[21] Appl. No.: 9,509

[22] Filed: Feb. 2, 1987

[51] Int. Cl.[4] ..... B65D 41/00

[52] U.S. Cl. ..... 220/90.4; 220/1 BC; 220/66; 220/90.2

[58] Field of Search ..... 220/90.2, 90.4, 90.6, 220/1 BC, 66; D9/68, 373, 375; 215/1 R

[56] References Cited

U.S. PATENT DOCUMENTS

| | | | |
|---|---|---|---|
| D. 170,639 | 10/1953 | Hoffman, Jr. | D9/375 |
| D. 264,811 | 6/1982 | Weckman | D9/375 |
| 2,119,502 | 5/1938 | Bertels | 220/1 BC |
| 3,412,892 | 11/1968 | Waksman et al. | 220/90.4 |
| 3,868,043 | 2/1975 | Freemyer | 220/90.4 |
| 4,441,624 | 4/1984 | Sokolowski | 220/90.4 X |

*Primary Examiner*—Steven M. Pollard
*Attorney, Agent, or Firm*—Wendell Coffee

[57] ABSTRACT

An angled top upon a beverage can permits the beverage to be drunk from the can without tilting the head.

3 Claims, 8 Drawing Figures

BEVERAGE CAN

BACKGROUND OF THE INVENTION (1) Field of the Invention

This invention relates to bevarage cans.

(2) Description of the Related Art

Many beverages are presently sold in cans. Typically the cans are 12 oz. cans which are also typically aluminum. The cans are cylinders having a flat bottom and flat top. Typically these beverage cans have "pop tops". I.e., they have spot which is frangible so that by manipulation of a tab or lever, either a portion of the top can be removed or a portion of the top can be folded down into the container so that the container is open and the contents can be drank from the container. Typically, also the top is recessed slightly, forming a rim around the edge of the container, this rim forming a drinking lip for consumption of the container.

Referring to FIGS. 1 and 2 of the drawings, it may be seen that when drinking the beverage, and particularly after the beverage is as much as half consumed, it is necessary for the consumer to tilt his head backwards to drink the beverage. Many people find this uncomfortable and undesirable.

Before this application was filed, the applicant caused a search to be made in the U.S. Patent and Trademark Office. The following patents were found on that search:

Bertels U.S. Pat. No. 2,119,502

Wackman U.S. Pat. No. Des. 128,060

BERTELS shows a can having a deeply recessed top so that when drinking from the container, the fluid or the liquid from the container flows into the top so that the sensation of the person drinking is more from drinking from a tumbler or glass than it is from drinking from a can. Although the patent does not discuss it, basically, a person's nose could be at least partially inserted into this top cavity so that it would not be necessary to tilt the head back as much, the same as when a person drinks from a glass or cup.

WACKMAN is reported here because the applicant believes the Examiner would consider anything revealed by an experienced patent searcher to be relevant and pertinent to the examination of this application.

SUMMARY OF THE INVENTION (1) Progressive Contribution to the Art

I have invented a can having a sloped top or an angled top. Therefore, as illustrated in the drawings, such as FIG. 3, when a person drinks from a can, the person's nose does not interfere with the top of the can so that it is not necessary for one drinking from the can to tilt their head back to drink all of the beverage contained in the can.

(2) Objects of this Invention

An object of this invention is to provide a beverage can.

Further objects are to achieve the above with a device that is sturdy, compact, durable, lightweight, simple, safe, efficient, versatile, ecologically compatible, energy conserving, and reliable, yet inexpensive and easy to manufacture, and drink from.

Further objects are to achieve the above with a device that is easy to store, has a long storage life, and is stable, yet inexpensive and easy to manufacture and drink from.

The specific nature of the invention, as well as other objects, uses, and advantages thereof, will clearly appear from the following description and from the accompanying drawing, the different views of which are not scale drawings.

Figure 1:
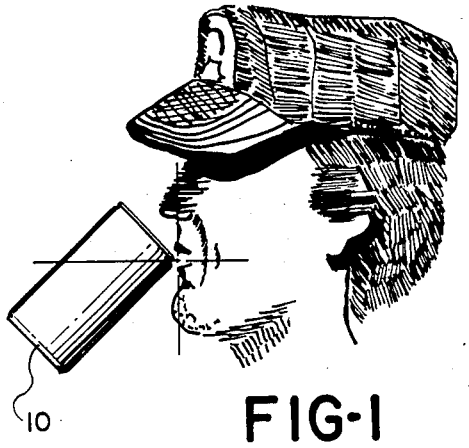
FIG. 1 shows an example of the prior art showing a person taking a first sip from a beverage within a can.

As an aid to correlating the terms of the claims to the exemplary drawing, the following catalog of elements and steps is provided:

10 prior art can
12 frangible spot
14 rim
16 invented can
18 cylindrical walls
20 bottom
22 top
24 tab
26 high side
28 low side
30 modified can
32 angled top
34 high side
36 break
38 low side

DESCRIPTION OF THE PREFERRED EMBODIMENTS

Figure 2:
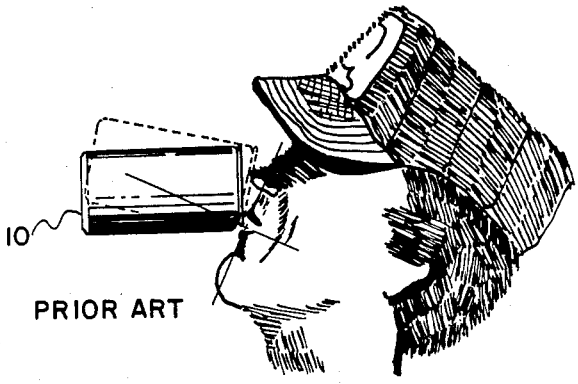
FIG. 2 also depicts the prior art showing a person drinking from a beverage can with the beverage can shown in solid line in its position when it is being nearly empty and the dotted line showing the position of the beverage can when the last of the beverage is being consumed.
Figure 6:
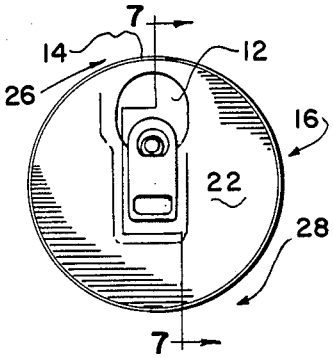
FIG. 6 is top plan view of a can according to this invention.

First, referring to the drawings to describe the prior art, it may be seen that when a person drinks from beverage can 10 of the prior art, it is necessary for him to tilt his head backwards as particularly shown in FIG. 2. It will be understood, referring to FIG. 6, that normally spot 12 of the beverage can which is removed is spaced from rim 14 a small distance. Therefore, it is necessary for the can to be tilted above level so that all or most of the beverage will drain inasmuch as the opening in the top does not extend all the way to the rim 14.

Figure 3:
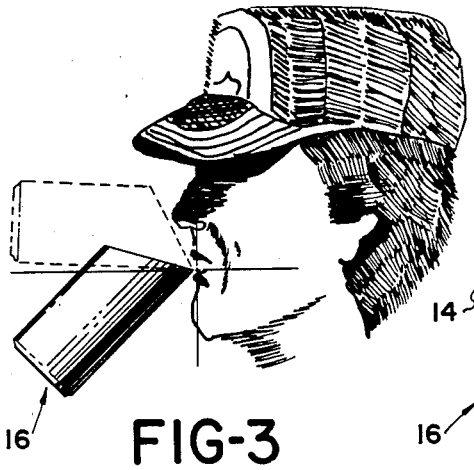
FIG. 3 depicts a person drinking from a can according to this invention with the full line of the can showing the position of the can when the first sip is being taken and the dotted line showing the position of the can when the last of the beverage is being consumed.

FIG. 3 shows a person drinking from improved can 16 of my invention.

Referring to the improved can it may be seen that the can 16 basically has a cylindrical shape having the cylindrical walls 18. The cylinder of the can 16 will have an axis. The bottom 20 of the can will be at right angles or normal to the axis of the cylinder. It will be remembered that in the prior art can 10 both the bottom and the top are normal to the axis of the cylinder.

Figure 7:
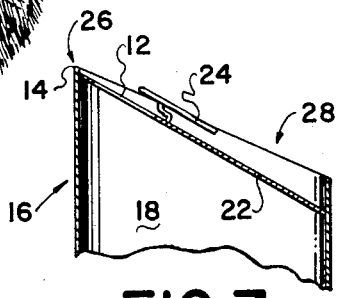
FIG. 7 is a side sectional view taken substantially along line 7—7 of FIG. 6.
Figure 4:
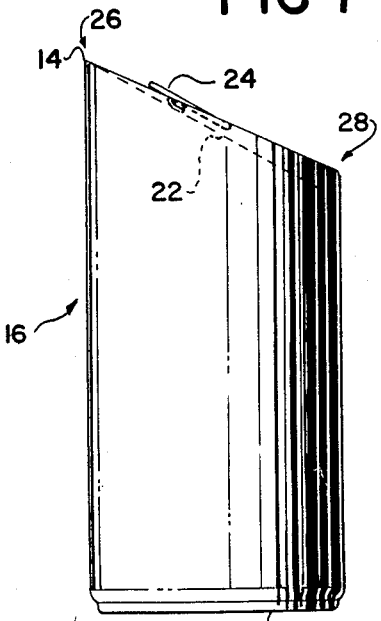
FIG. 4 is a side elevational view of a can according to this invention.
Figure 5:
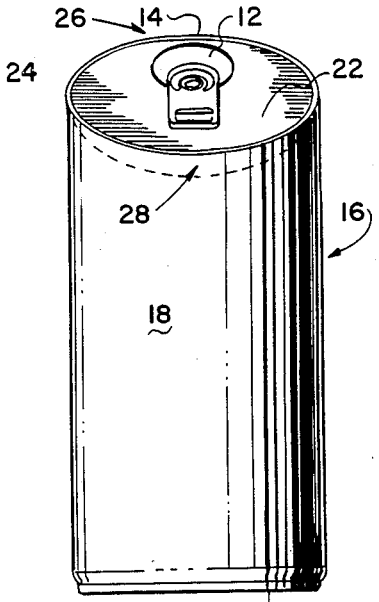
FIG. 5 is a front elevational view of a can according to this invention.

However, top 22 of the can 16 is angled or sloping to the axis of the cylinder. The top will form an angle of about 30° to the bottom which is to say that it will have an angle of about 60° to the axis. When using the term "about 30°", it will be understood that this angle could vary from that, and it is intended that "about 30°" to cover an angle of about 25° to 35° to the bottom which would be an angle of about 55° to 65° to the axis of the cylinder. As may be seen in FIGS. 4, 5, and 7, the edge of the rim 14 of the can will have less of an angle to the bottom than the top. I.e., the edge of the rim 14 will be about a 25° angle to the bottom of the can which will be about 65° to the axis of the can.

The angled top will result in there being a high side 26 of the top and a low side 28 of the top.

Frangible spot 12 on the high side 26, by the manipulation of tab 24, opens the can so that the beverage within the can 16 could readily be consumed from the can. Such construction is well known at the time of my invention.

Figure 8:
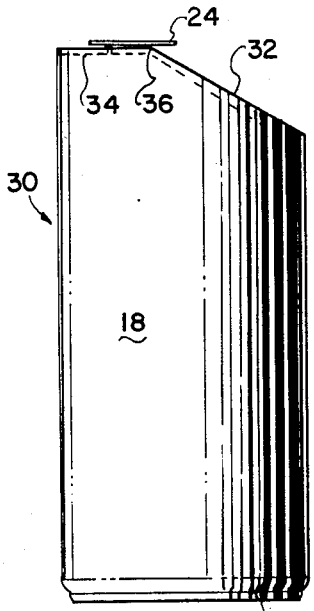
FIG. 8 is a representation of a modified form of the invention.

FIG. 8 shows can 30, a modified form of my invention. The modified can 30 has a cylindrical walls 18 and bottom 20 normal to the axis of the cylindrical walls 18. The modified can 30 also has angled top 32 but only partially so. The high side 34 of the top is flattened. I.e., the high side 34 is parallel to the bottom 20 or normal to the axis of the cylinder 18. The frangible sport 12 with the tab 24 is located upon this high side 34. The top is bent or broken along edge 36 so that low side 38 angles downward. I.e., the low side 38 of the top is angled to the axis.

The embodiments shown and described above are only exemplary. I do not claim to have invented all the parts, elements or steps described. Various modifications can be made in the construction, material, arrangement, and operation, and still be within the scope of my invention.

The restrictive description and drawing of the specific examples above do not point out what an infringement of this patent would be, but are to enable one skilled in the art to make and use the invention. The limits of the invention and the bounds of the patent protection are measured by and defined in the following claims.

Subject matter claimed for protection I claim as my invention:

1. A beverage can comprising:

a. a cylindrical body having b. an axis, c. a bottom normal to said axis, d. a planner top angled to the axis so that there is:

i. a high side of the top, and ii. a low side of the top, and e. a frangible spot at the high side of the top so that beverage may be drunk from the can without the necessity of tilting the head.

2. The invention as defined in claim 1 wherein:

f. said top is angled to the axis at an angle of about 30°.

3. A beverage can comprising:

a. a cylindrical body having b. an axis, c. a bottom normal to said axis, d. a top having a portion angled to the axis so that there is:

i. a low side of the top angled at an angle of 30° to the axis, ii. a high side of the top, and iii. said high side parallel to said bottom and normal to the axis, and e. a frangible spot with an attached tab on the high side of the top so that beverage may be drunk from the can without the necessity of tilting the head.

* * * * *